United States Patent [19]

Snyders

[11] 4,378,412

[45] Mar. 29, 1983

[54] PROTECTIVE RING COVERS FOR STOVES

[76] Inventor: Johan H. Snyders, 53 Nelson Rd., Vishoek 7975, South Africa

[21] Appl. No.: 298,304

[22] Filed: Sep. 1, 1981

[51] Int. Cl.[3] ..... B21C 37/00

[52] U.S. Cl. ..... 428/573; 99/444; 99/446; 126/215; 219/443; 219/462; 428/582; 428/596; 428/595; 220/200

[58] Field of Search ..... 219/386, 443, 444, 458, 219/461, 462, 464, 530; 220/200; 126/51, 214 C, 215, 221, 385; 215/200, 274; 174/66; 292/256.6; 428/174, 189, 604, 606, 913, 573, 582, 595, 596; 99/446, 442, 444; 29/183

[56] References Cited

U.S. PATENT DOCUMENTS

| | | | |
|---|---|---|---|
| 1,698,926 | 1/1929 | Wentorf et al. | 126/215 |
| 2,135,318 | 11/1938 | Barkinsky et al. | 99/446 |
| 2,532,461 | 12/1950 | Reeves | 126/214 C |
| 2,583,887 | 1/1952 | Schneeweiss | 126/215 X |
| 2,742,850 | 4/1956 | La Fond | 99/446 |
| 2,797,298 | 6/1957 | Fujitani | 219/443 |
| 4,045,606 | 8/1977 | Kalliowski | 428/174 |

FOREIGN PATENT DOCUMENTS

| | | | |
|---|---|---|---|
| 442557 | 1/1968 | Switzerland | 219/443 |
| 1093485 | 12/1967 | United Kingdom | 219/443 |

*Primary Examiner*—Volodymyr Y. Mayewsky
*Attorney, Agent, or Firm*—Larson and Taylor

[57] ABSTRACT

A protective ring cover for cooking element stove rings. It comprises an annular body shaped to conform to the upper shape of a cooking element stove ring, which is to be covered. The annular body in cross-section is of inverted substantially U-shape with an outwardly directed flange at the outer leg of the U-shape. The cover is made of non-inflammable material (e.g. aluminum) and is adapted to fit removably onto a cooking element stove ring.

1 Claim, 4 Drawing Figures

PROTECTIVE RING COVERS FOR STOVES

BACKGROUND OF INVENTION

1. Field of the Invention

The present invention relates to protective ring covers.

More particularly, the invention relates to protective ring covers for cooking element stove rings.

The cooking elements of the domestic electrical stoves, which normally are of coil shape or in the form of plates, generally are surrounded by attractive chromeplated rings. These rings often are soiled by the overboiling of pots, etc. It is fairly cumbersome and time consuming to clean these rings. Another problem is that the rings are sometimes permanently fixed and because such rings cannot be removed, cleaning is made even more difficult.

It is an object of the invention to suggest a method and means for overcoming the problem stated above.

2. Brief Description of the Invention

According to the invention, a protective ring cover for cooking element stove rings, comprises (a) an annular body shaped to conform to the upper shape of a cooking element stove ring, which is to be covered, the annular body being in cross-section of inverted substantially U-shaped and being made of a non-inflammable aluminium foil material and being adapted to fit removably onto a cooking element stove ring;

(b) an outwardly directed flange formed at the outer leg of the U-shape of the annular body;

(c) a reinforcement ring surrounding the outer edge of the annular flange, which is bent over the reinforcement ring; and (d) an annular container formed between the reinforcement ring and the outer leg of the U-shaped annular body for receiving at least some of the spillover of cooking material.

DESCRIPTION OF THE DRAWINGS

The invention will now be described by way of example with reference to the accompanying schematic drawings.

In the drawings there is shown in

In FIG. 1 a standard cooking stove element in the form of a coil 10 is shown. The coil 10 is surrounded by a stove ring 12. When pots boil over or if other cooking material drops onto the ring 12, it is soiled and becomes unattractive. Due to the heat existing at the ring 12, the soiling material is often burned into the ring surface making it difficult to remove. Another problem is that the ring 12 is sometimes fixed permanently to the stove structure and cannot be removed for cleaning.

Figure 2:
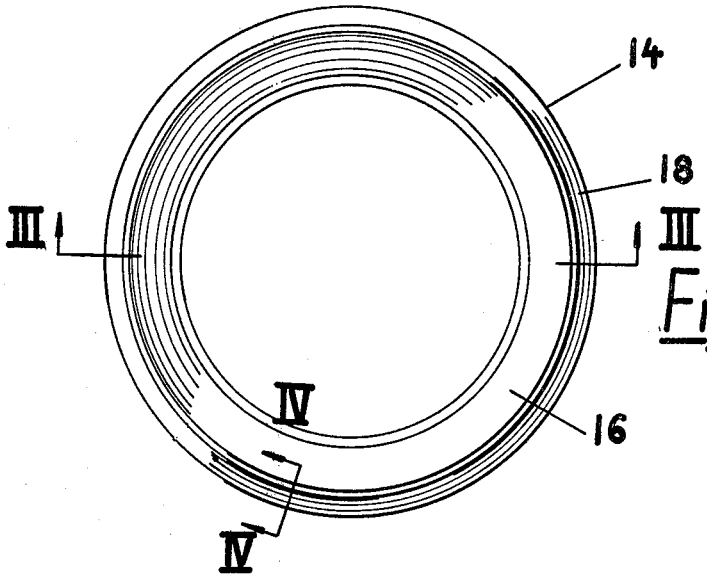
FIG. 2 a plan view of a protective ring cover in accordance with the invention and intended to cover the ring illustrated in FIG. 1.
Figure 3:
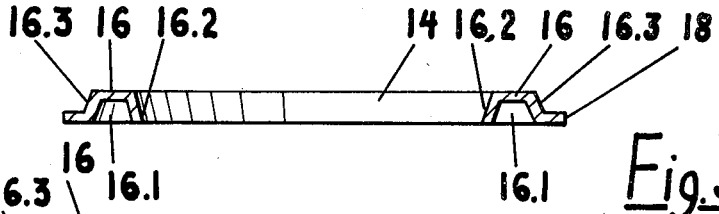
FIG. 3 a sectional side view of the cover seen along arrows III—III in FIG. 2.
Figure 4:
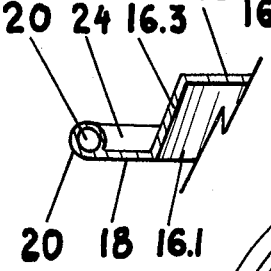
FIG. 4 on a larger scale, a sectional side view of the edge of the stove ring seen along arrows IV—IV in FIG. 2.
Figure 1:
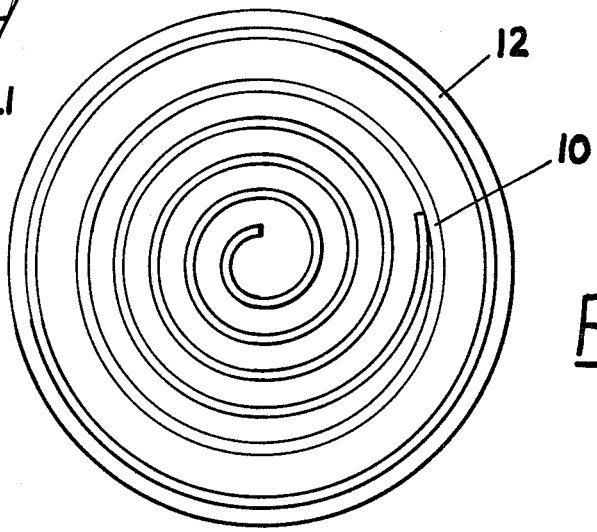
FIG. 1 A plan view of a standard cooking stove element (here in the form of a coil) surrounded by a ring.

The protective ring cover 14, as suggested by the invention, is illustrated in FIGS. 2, 3 and 4. This cover 14 has an annular body 16 which is of inverted U-shape with an outwardly directed flange 18. It is pressed from aluminium foil, and in use is fitted tightly over the stove ring 12 shown in FIG. 1. This is done in that the stove ring 12 fits into the space 16.1 defined between the inner leg 16.2 and the outer leg 16.3 of the U-shaped body 16. If any cooking material is spilled over, it would fall onto the cover 14. If the cover 14 cannot be wiped for cleaning it, it is removed and is replaced by a new clean cover 14.

As shown in FIG. 4, the outer edge of the flange 18 may be thickened or raised (e.g. by providing a wire ring 20 or the like over which the edge of the foil is folded) to form an annular wall 22. The thickened or raised wall 22 defines an annular container 24 between itself and the outer leg 16.3 of the U-shaped body 16. At least some of the overboiled material therefore can collect in this container 24 and thus the wall 22 assists in preventing cooking material from flowing onto the stove panel surface adjacent the coil 10.

I claim:

1. A protective ring cover for cooking element stove rings, which comprises (a) an annular body shaped to conform to the upper shape of a cooking element stove ring, which is to be covered, the annular body being in cross-section of inverted substantially U-shape and being made of a non-inflammable aluminum foil material and being adapted to fit removably onto a cooking element stove ring;

(b) an outwardly directed flange formed at the outer leg of the U-shape of the annular body;

(c) a reinforcement ring surrounding the outer edge of the annular flange, which is bent over the reinforcement ring; and (d) an annular container formed between the reinforcement ring and the outer leg of the U-shaped annular body for receiving at least some of the spillover of cooking material.

* * * * *